US009540162B2

(12) United States Patent
Sperry

(10) Patent No.: US 9,540,162 B2
(45) **Date of Patent: *Jan. 10, 2017**

(54) MACHINE FOR INFLATING AND SEALING AN INFLATABLE STRUCTURE

(71) Applicant: Sealed Air Corporation (US), Elmwood Park, NJ (US)

(72) Inventor: Laurence Sperry, Newton, MA (US)

(73) Assignee: Sealed Air Corporation (US), Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/623,926

(22) Filed: Feb. 17, 2015

(65) Prior Publication Data

US 2015/0158650 A1 Jun. 11, 2015

Related U.S. Application Data

(63) Continuation of application No. 12/497,247, filed on Jul. 2, 2009, now Pat. No. 8,991,141, which is a (Continued)

(51) Int. Cl.
*B65B 31/06* (2006.01)
*B65B 31/02* (2006.01)

(Continued)

(52) U.S. Cl.
CPC ..... *B65D 81/052* (2013.01); *B31D 5/0073* (2013.01); *B65B 31/02* (2013.01); *B65B 31/04* (2013.01);

(Continued)

(58) Field of Classification Search
CPC ..... B31D 9/13; B31D 5/0073; B65B 31/06; B65B 31/02; B65B 31/04; B65B 9/20; B65B 31/022; B29C 65/00

(Continued)

(56) References Cited

U.S. PATENT DOCUMENTS 2,064,115 A * 12/1936 Holsman ..... 40/472
5,938,580 A 8/1999 Siekmann (Continued)

FOREIGN PATENT DOCUMENTS

CN 101208194 A 6/2008
JP H6-100036 A 4/1994

(Continued)

OTHER PUBLICATIONS

International Preliminary Examining Authority, International Preliminary Report on Patentability for International Application No. PCT/US2010/028079, dated Jul. 25, 2010, 25 pages, European Patent Office, Germany.

(Continued)

*Primary Examiner* — Michelle Lopez
(74) *Attorney, Agent, or Firm* — Alston & Bird LLP

(57) ABSTRACT

A machine for inflating and sealing an inflatable structure having a longitudinal edge generally comprises a drive, an inflation nozzle, a sealing device, and a sheet engagement device. The machine may define an engaging assembly and an opposing assembly. The drive may be rotationally coupled to the sheet engagement device such that when the drive rotates, the engagement device also rotates. The sheet engagement device may comprise one or more engagement rollers which may have a plurality of teeth thereon. A first plurality of rollers and a second plurality of rollers comprising the engagement rollers may intermesh between a drive roller and a backing roller on the longitudinal edge of the inflatable structure. Thereby, the sheets of the inflatable structure may be engaged together and the length of the longitudinal edge may contract to facilitate inflation. The resulting inflated inflatable structure may comprise an embossed longitudinal edge.

6 Claims, 6 Drawing Sheets

Related U.S. Application Data continuation-in-part of application No. 12/419,133, filed on Apr. 6, 2009, now Pat. No. 8,978,345.

(51) Int. Cl.
*B65B 31/04* (2006.01)
*B65D 81/05* (2006.01)
*B31D 5/00* (2006.01)

(52) U.S. Cl.
CPC ..... *B65B 31/06* (2013.01); *B31D 2205/0047* (2013.01); *B31D 2205/0064* (2013.01)

(58) Field of Classification Search
USPC ..... 53/79, 403, 450, 453, 553
See application file for complete search history.

(56) References Cited

U.S. PATENT DOCUMENTS

| | | | | |
|---|---|---|---|---|
| 6,410,119 | B1 | 6/2002 | De Luca et al. | |
| 6,659,150 | B1 | 12/2003 | Perkins et al. | |
| 6,761,960 | B2 | 7/2004 | De Luca et al. | |
| 7,165,375 | B2 | 1/2007 | O'Dowd | |
| 7,174,696 | B2 | 2/2007 | Perkins et al. | |
| 7,220,476 | B2 | 5/2007 | Sperry et al. | |
| 7,389,625 | B2 | 6/2008 | Nakagawa et al. | |
| 7,389,626 | B2 | 6/2008 | Sperry et al. | |
| 7,429,304 | B2 | 9/2008 | McNamara, Jr. et al. | |
| 7,438,675 | B2 | 10/2008 | Lin | |
| 7,490,449 | B1 | 2/2009 | Eibert | |
| 8,978,345 | B2 | 3/2015 | Sperry | |
| 8,991,141 | B2 * | 3/2015 | Sperry et al. | 53/403 |
| 2005/0281489 | A1 * | 12/2005 | Yeh et al. | 383/35 |
| 2006/0090421 | A1 | 5/2006 | Sperry et al. | |
| 2007/0011989 | A1 | 1/2007 | Sperry et al. | |
| 2007/0180792 | A1 | 8/2007 | Sperry et al. | |
| 2007/0251631 | A1 | 11/2007 | Garceau et al. | |
| 2007/0273077 | A1 * | 11/2007 | Kling | 270/41 |
| 2008/0022630 | A1 * | 1/2008 | Fuss et al. | 53/79 |

FOREIGN PATENT DOCUMENTS

| | | | |
|---|---|---|---|
| JP | 10-501752 | | 2/1998 |
| JP | 2005-091032 | A | 4/2005 |
| JP | 2005-518969 | A | 6/2005 |
| JP | 2005-234343 | A | 9/2005 |

OTHER PUBLICATIONS

International Searching Authority, International Search Report and Written Opinion for International Application No. PCT/US2010/028079, dated Sep. 27, 2010, 21 pages, European Patent Office, The Netherlands.
Japan Patent Office, Notice of Rejection for Application No. 2012-504692, mailed Mar. 11, 2014, 2 pages, Japan.
Japan Patent Office, Notice of Rejection for Application No. 2012-504692, mailed Feb. 26, 2013, 4 pages, Japan.
Mexican Institute of Industrial Property, Office Action for Application No. MX/a/2011/010500, May 30, 2014, 7 pages, Mexico.
Partial Search Report for International Application No. PCT/US2010/028079 mailed Jul. 9, 2010.
State Intellectual Property Office of the People's Republic of China, First Office Action for Application No. 201080025849.4, dated Feb. 17, 2013, 6 pages, China.
State Intellectual Property Office, Office Action and Search Report for Application No. 201080025849.4, Jun. 16, 2014, 25 pages, The People's Republic of China.
U.S. Appl. No. 12/419,133, filed Apr. 6, 2009 U.S. Pat. No. 8,978,345; Sperry, Laurence.
United States Patent and Trademark Office, Office Action for U.S. Appl. No. 12/419,133, dated Aug. 15, 2013, 8 pages, USA.
United States Patent and Trademark Office, Office Action for U.S. Appl. No. 12/419,133, dated Dec. 13, 2012, 8 pages, USA.
United States Patent and Trademark Office, Office Action for U.S. Appl. No. 12/419,133, dated Oct. 11, 2011, 6 pages, USA.
United States Patent and Trademark Office, Office Action for U.S. Appl. No. 12/419,133, dated Mar. 15, 2012, 9 pages, USA.
United States Patent and Trademark Office, Office Action for U.S. Appl. No. 12/497,247, dated Oct. 27, 2011, 6 pages, USA.
United States Patent and Trademark Office, Office Action for U.S. Appl. No. 12/497,247, dated May 10, 2012, 6 pages, USA.
United States Patent and Trademark Office, Office Action for U.S. Appl. No. 12/497,247, dated Nov. 6, 2012, 6 pages, USA.
United States Patent and Trademark Office, Notice of Allowance for U.S. Appl. No. 12/497,247, dated Oct. 21, 2014, 12 pages, USA.
Japan Patent Office, Notice of Rejection for Application No. 2015-087304, Jul. 5, 2016, 8 pages, Japan.

* cited by examiner

MACHINE FOR INFLATING AND SEALING AN INFLATABLE STRUCTURE

CROSS-REFERENCE TO RELATED APPLICATION

This application is a continuation of U.S. application Ser. No. 12/497,247, filed Jul. 2, 2009 and now U.S. Pat. No. 8,991,141, which is a continuation-in-part of U.S. application Ser. No. 12/419,133, filed Apr. 6, 2009 and now U.S. Pat. No. 8,978,345, all of which are hereby incorporated herein in their entirety by reference.

BACKGROUND OF THE INVENTION

1. Field of the Invention

The present invention generally relates to inflatable structures, such as inflatable packaging, and further to improved machines and methods for inflating the same.

2. Description of Related Art

Inflatable structures constitute an important part of the packaging industry. Inflatable structures are commonly used as cushions to package items, either by wrapping the items in the inflatable structures and placing the wrapped items in a shipping carton, or by simply placing one or more inflatable structures inside of a shipping carton along with an item to be shipped. The cushions protect the packaged item by absorbing impacts that might otherwise be fully transmitted to the packaged item during transit, and also restrict movement of the packaged item within the carton to further reduce the likelihood of damage to the item.

Various machines for forming inflated cushions, pillows, or other inflated structures are known. Earlier machines for forming inflated cushions tended to be rather large, expensive and complex. More recently, smaller, less-expensive inflation machines have been developed, which employ inflatable structures having pre-formed inflatable chambers. Many such machines, however, produce excessive noise and require relatively high pressures for the fluid used to inflate the inflatable structures.

Accordingly, there remains a need in the art for a low cost yet reliable machine for producing fluid-filled inflatable structures which operates relatively quietly and uses relatively low fluid pressure to fill the inflatable structures.

BRIEF SUMMARY OF THE INVENTION

These and other advantages are provided by the herein presented machines for inflating an inflatable structure having a longitudinal edge, at least two sheets, and a series of inflatable chambers formed between the sheets, each of the inflatable chambers being capable of holding therein a quantity of a fluid and having an opening proximate the longitudinal edge for receiving the fluid during inflation. Such machines and associated methods may efficiently and quietly inflate inflatable structures.

In particular, the machines may include a drive for advancing the inflatable structure in a machine direction substantially parallel to the longitudinal edge, an inflation nozzle positioned to direct the fluid into the openings of the inflatable chambers as the inflatable structure is advanced in the machine direction to thereby inflate the inflatable chambers, a sealing device located proximate the inflation nozzle for sealing closed the openings of the inflatable chambers after they are inflated with the fluid, and a sheet engagement device configured to engage the sheets together along the longitudinal edge of the inflatable structure and adjacent to the inflation nozzle to facilitate inflation of the inflatable chambers prior to the inflatable chambers being sealed. The sheet engagement device may both aid in directing fluid into the inflatable chambers by preventing it from flowing out the longitudinal edge, and may further help keep the openings to the inflatable chambers open during inflation by contracting the length of the longitudinal edge.

The sheet engagement device may include a first belt and an opposing second belt, each defining a plurality of teeth which intermesh with the teeth of the other belt, causing a reduction in a dimension of the longitudinal edge in the machine direction. Such teeth may extend perpendicularly to the machine direction. In other embodiments the teeth may extend longitudinally, in which case they may engage one or more longitudinally extending grooves in the other belt. Alternatively, the first belt and/or the opposing second belt may be untoothed on their respective first external and second external surfaces. Additionally, the sheet engagement device may further comprise an engaging body and an opposing body, wherein the engaging body and the opposing body engage the first belt and the opposing second belt therebetween and wherein the engaging body, the opposing body, and the inflation nozzle overlap in the machine direction.

In a further embodiment, the sheet engagement device may comprise one or more engagement rollers. The engagement rollers may in turn comprise a first plurality of rollers positioned on one side of the sheets and a second plurality of rollers positioned on an opposite side of the sheets. One or more engagement rollers may comprise teeth, and the first plurality of rollers may intermesh with the second plurality of rollers so as to thereby reduce a dimension of the longitudinal edge in the machine direction.

The machine may further include an engaging assembly and an opposing assembly with the drive advancing the inflatable structure therebetween. A release mechanism may be configured to displace at least a portion of the opposing assembly from the engaging assembly by a displacement distance and may also displace the inflation nozzle from the engaging assembly by an intermediate displacement distance which is less than the displacement distance of the engaging and opposing assemblies. Such displacements may make feeding an inflatable structure into the machine easier.

The drive may be rotationally coupled to the sheet engagement device such that the sheet engagement device operates simultaneously with the drive advancing the inflatable structure. In one such embodiment, the drive may be rotationally coupled to the engagement rollers such as through a transmission roller. The engagement rollers may advance the inflatable structure at a different speed, such as a slower speed, than the speed at which the drive attempts to advance the inflatable structure. Additionally, the sealing device may include a sealing element in the engaging assembly and at least one backing roller in the opposing assembly. The sealing element may comprise a resistive heating element which may be wrapped around a drive roller.

A method of inflating an inflatable structure is also provided. The method may comprise advancing the inflatable structure in a machine direction substantially parallel to the longitudinal edge of the inflatable structure, engaging the sheets together along the longitudinal edge such as with one or more engagement rollers, directing a flow of fluid from an inflation nozzle into openings in the inflatable structure, and sealing the openings. In such a method, the step of directing the flow may occur during the step of engaging the sheets.

With regard to the step of engaging the sheets, this step may comprise contracting the length of the longitudinal edge of the inflatable structure. Additionally, the step of contracting the length may comprise engaging the longitudinal edge between a first belt and an opposing second belt each defining a plurality of teeth and/or between a first plurality of rollers and a second plurality of rollers. The step of contracting the length may further comprise embossing the longitudinal edge. Also, the method may additionally comprise separating a first sheet of the inflatable structure from a second sheet of the inflatable structure such that the step of advancing the inflatable structure comprises advancing the first sheet and the second sheet on opposite sides of the inflation nozzle.

Further, an inflated structure is provided. The inflated structure may comprise at least two sheets, an embossed longitudinal edge, and a series of inflated chambers formed between the sheets, each of the inflated chambers holding therein a quantity of a fluid and having a sealed opening proximate the embossed longitudinal edge.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
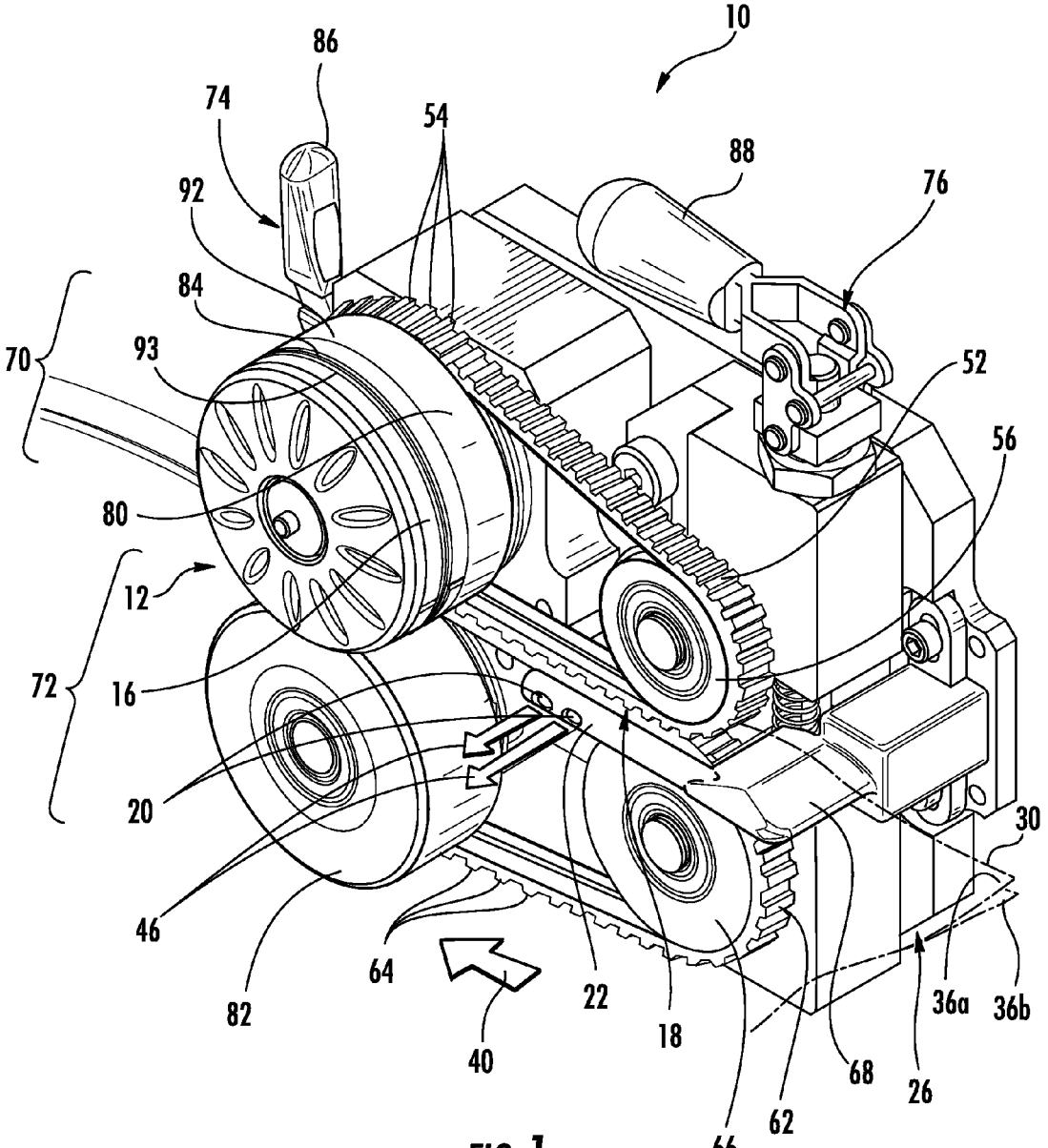
FIG. 1 is a perspective view of an embodiment of a machine for inflating and sealing an inflatable structure comprising an engaging assembly and an opposing assembly with first and second release mechanisms and a first belt and an opposing second belt having pluralities of teeth.

FIG. 1 illustrates a machine 10 for inflating and sealing an inflatable structure 26 in accordance with the present invention. Machine 10 generally comprises a drive 12, an inflation nozzle 22, a sealing device 16, and a sheet engagement device 18. The drive 12 may comprise a drive roller 80 and a backing roller 82 which may be positioned such that a nip, i.e., an area of tangential contact, is formed therebetween when the drive roller and the backing roller contact. At least one of the rollers, such as the drive roller 80, may be linked to a motor to form the drive 12 such that, when power is supplied to the motor, the drive roller rotates. When the drive roller 80 is in contact with the backing roller 82, the backing roller may also rotate. As will be described in detail below, this may advance the inflatable structure 26. The outer surface 92 of the drive roller 80 may be roughened or knurled to facilitate traction with the inflatable structure 26 to minimize slippage as the drive roller rotates against the inflatable structure to advance the inflatable structure in a machine direction 40. To further facilitate advancing of the inflatable structure 26, the backing roller 82 may be formed from a pliant material, such as, e.g., rubber or RTV silicone. Other materials, e.g., metal with a knurled surface, may also be used for the backing roller 82 as desired, particularly when the backing roller is mounted to the machine 10 using a suspension system which ensures that the backing roller properly contacts the drive roller 80 and the sealing device 16 during operation.

The sheet engagement device 18 may be configured to engage a first sheet 36*a* and a second sheet 36*b* forming the inflatable structure 26 together along a longitudinal edge 30 of the inflatable structure. For example, the sheet engagement device 18 may comprise a first belt 52 defining a plurality of teeth 54, and an opposing second belt 62 defining a plurality of teeth 64. The first belt 52 may extend around the drive roller 80, and may additionally extend around an engaging roller 56. The opposing second belt 62 may extend around the backing roller 82, and may also extend around an opposing roller 66. Further, the plurality of teeth 54, 64 of the first belt 52 and the opposing second belt 62 may be oriented such that they face outwardly from a first external surface of the first belt and a second external surface of the opposing second belt such that they do not touch the respective rollers 80, 56, 82, 66 that they extend around. Instead, the plurality of teeth 54 from the first belt 52 may engage the plurality of teeth 64 from the opposing second belt 62 in an intermeshing manner. The sheet engagement device 18 may be rotationally coupled to the drive 12, such that when the motor rotates the drive, including the drive roller 80, the sheet engagement device also rotates, as will be described below. In alternate embodiments, instead of using a driver roller, the sheet engagement device may serve as the drive for the inflatable structure, with the two belts advancing the inflatable structure in the machine direction. In such embodiments, a non-rotary sealing device, such as a flat sealing bar and other similar known sealing devices may be used to seal the inflatable structure.

Although the pluralities of teeth 54, 64 are shown as being oriented generally perpendicular to the machine direction 40, the pluralities of teeth may be oriented in other directions, for example longitudinally, such that they generally align with the machine direction. In such a configuration, when one of the first belt 52 or the opposing second belt 62 has longitudinally oriented teeth, the other of the first belt and the second belt may comprise one or more longitudinally extending grooves. In such an embodiment the longitudinally extending teeth may engage the one or more longitudinally extending grooves. In alternate embodiments, one or both of the first external surface of the first belt 52 and the second external surface of the opposing second belt 62 may be untoothed.

The machine 10 may further include an inflation nozzle 22 for inflating the inflatable structure 26 with a fluid 46. The inflation nozzle 22 may be positioned such that the sheet engagement device 18 is adjacent to the inflation nozzle, which aids in inflation of the inflatable structure 26 as will be described below. The inflation nozzle 22 may take many different forms, with the location of the outlet(s) 20 of the inflation nozzle being an important design consideration. As described above, the inflation nozzle 22 may be adjacent to the sheet engagement device 18, such as with the first belt 52 and the second belt 62 positioned between the nozzle 22 and the remainder of the machine 10. The machine may further comprise a plow 68, which separates the first sheet 36*a* of the inflatable structure 26 from the second sheet 36*b* of the inflatable structure. Such a plow 68 may comprise an integral portion of the nozzle 22, as illustrated in the machine 10 of FIG. 1, or alternatively, the plow may comprise a separate component of the machine. Alternatively, the nozzle 22 may comprise a tubular structure which separates the first sheet 36*a* and the second sheet 36*b*.

The machine 10 may further define an engaging assembly 70 and an opposing assembly 72. The engaging assembly 70 may comprise the drive roller 80, the sealing device 16, the engaging roller 56, and the first belt 52. The opposing assembly 72 may comprise the backing roller 82, the opposing roller 66, and the second belt 62. As shown in FIG. 1, the machine 10 may further include one or more release mechanisms 74, 76 to which all or a portion of the opposing assembly 72 and/or the engaging assembly 70 is mounted. The release mechanisms 74, 76 allow the opposing assembly 72 to be moved relatively toward and away from the engaging assembly 70. For instance, a first release mechanism 74 may displace the backing roller 82 from the drive roller 80 and sealing device 16, and conversely back into contact with the drive roller and sealing device. Similarly, a second release mechanism 76 may move the opposing roller 66 away from the engaging roller 56, and conversely back into contact with the engaging roller. The advantages resulting from the ability to relatively move the opposing assembly 72 away form the engaging assembly 70 will be described below.

The sealing device 16 may be integral with the drive roller 80, or comprise a separate roller, as shown. Further, the sealing device 16 may comprise a sealing element 84. The sealing element 84 may be a resistive element, which produces heat when electricity is supplied thereto, and can have any desired shape or configuration. As shown, the sealing element 84 is in the form of a wire. Thus, the sealing device 16 may be formed from any material that is capable of withstanding the temperatures generated by the sealing element 84, such as metal, e.g., electrically insulated aluminum; high-temperature-resistant polymers, e.g., polyimide; ceramics; etc. A groove 93 may be provided in the sealing device 16 to accommodate the sealing element 84 and keep it in proper position to seal the inflatable structure 26. An engaging assembly 70 having a sealing device 16 with a sealing element 84 may therefore engage the backing roller 82 from the opposing assembly 72 to seal the inflatable structure 26 which travels therebetween, as will be described in greater detail below.

Figure 2:
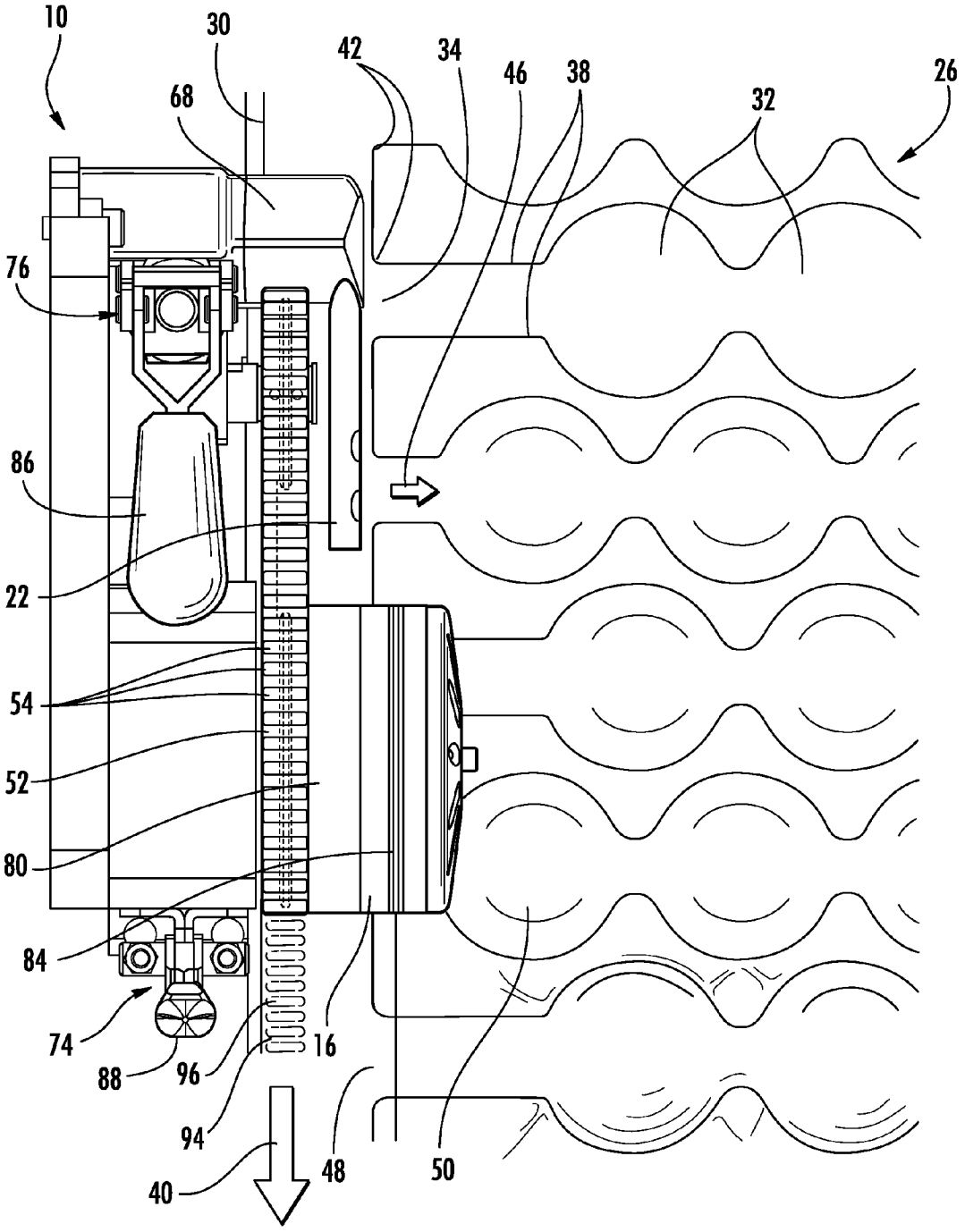
FIG. 2 is a top view of the embodiment of the machine of FIG. 1 in operation.

FIG. 2 illustrates a top view of the machine 10 of FIG. 1 being used to inflate and seal an inflatable structure 26. The inflatable structure 26 may, in general, comprise any flexible film material that can be manipulated by the machine 10 to enclose a fluid 46 as herein described, including various thermoplastic materials, e.g., polyethylene homopolymer or copolymer, polypropylene homopolymer or copolymer, etc. Non-limiting examples of suitable thermoplastic polymers include polyethylene homopolymers, such as low density polyethylene (LDPE) and high density polyethylene (HDPE), and polyethylene copolymers such as, e.g., ionomers, EVA, EMA, heterogeneous (Zeigler-Natta catalyzed) ethylene/alpha-olefin copolymers, and homogeneous (metallocene, single-cite catalyzed) ethylene/alpha-olefin copolymers. Ethylene/alpha-olefin copolymers are copolymers of ethylene with one or more comonomers selected from C3 to C20 alpha-olefins, including linear low density polyethylene (LLDPE), linear medium density polyethylene (LMDPE), very low density polyethylene (VLDPE), and ultra-low density polyethylene (ULDPE). Various other polymeric materials may also be used such as, e.g., polypropylene homopolymer or polypropylene copolymer (e.g., propylene/ethylene copolymer), polyesters, polystyrenes, polyamides, polycarbonates, etc. The film may be monolayer or multilayer and can be made by any known extrusion process by melting the component polymer(s) and extruding, coextruding, or extrusion-coating them through one or more flat or annular dies.

In the illustrated embodiment, the inflatable structure 26 has a longitudinal edge 30 and includes a series of preformed inflatable chambers 32 formed between the first sheet 36*a* and the second sheet 36*b* (see FIG. 1). Each of the inflatable chambers 32 is capable of holding therein a quantity of fluid 46, e.g., air, and each has an opening 34 at the longitudinal edge 30 for receiving such fluid. As illustrated in FIG. 2, the inflatable chambers 32 may be defined between transverse seals 38. The openings 34 of the inflatable chambers 32 are formed near the longitudinal edge 30 of the inflatable structure 26 at the ends 42 of the transverse seals 38. The ends 42 of the transverse seals 38 are spaced from the longitudinal edge 30, in order to accommodate the inflation nozzle 22 within the inflatable structure 26, i.e., between the sheets 36*a*, 36*b* (see FIG. 1), while the other ends of the transverse seals terminate at a closed edge. The closed edge could be either a fold forming the first sheet 36*a* and the second sheet 36*b*, such as when a single piece of film forms the inflatable structure 26, or the closed edge could comprise a seal between a separate first sheet and second sheet which have been joined together.

To begin operation, an inflatable structure 26 is fed between the engaging assembly 70 and the opposing assembly 72 (see FIG. 1) from, for example, a roll of the inflatable structure stored on a spool. In some embodiments, one or more of the spool, engaging assembly 70, and opposing assembly 72 may form an angle with respect to horizontal such that the closed edge of the inflatable structure 26 sits at a higher elevation than the longitudinal edge 30 of the inflatable structure as the inflatable structure is advanced through the machine 10. In such embodiments the alignment of the longitudinal edge 30 with the machine direction 40 may be improved.

The feeding of the inflatable structure 26 between the engaging assembly 70 and the opposing assembly 72 may also be facilitated by using the release mechanisms 74, 76. As described above, the second release mechanism 76 may move the opposing roller 66 downwardly away from the engaging roller 56, and the first release mechanism 74 may move the backing roller 82 downwardly away from the drive roller 80 by a user grasping and moving a second handle member 88 and a first handle member 86, respectively (see FIG. 1). Thus, the first release mechanism 74 and the second release mechanism 76 may facilitate the feeding of an inflatable structure 26 between the engaging assembly 70 and the opposing assembly 72, e.g., upon replacement of the roll of the inflatable structure on the spool and subsequent threading of the new inflatable structure through the above-described components of the machine 10 in the machine direction 40. Once the threading is complete, the first handle member 86 and the second handle member 88 are moved back to their operating positions as shown in FIGS. 1 and 2, so that the engaging assembly 70 and the opposing assembly 72 are in compressive contact with opposing sides of the inflatable structure 26 and ready to begin withdrawing the inflatable structure from the roll and advancing the inflatable structure in the machine direction 40.

As seen in FIG. 1, before the inflatable structure 26 travels between the engaging assembly 70 and the opposing assembly 72, the longitudinal edge 30 of the inflatable structure 26 is open, i.e., unsealed. This enables the first sheet 36*a* and the second sheet 36*b* to separate to locations on opposite sides of the plow 68 and around the nozzle 22 as the inflatable structure 26 is advanced in the machine direction 40. However, the first layer 36*a* and the second layer 36*b* are engaged together by the sheet engagement device 18 along the longitudinal edge 30 of the inflatable structure 26. This occurs as the drive roller 80 rotates and hence advances the inflatable structure 26 between the engaging assembly 70 and the opposing assembly 72 in the machine direction 40, with the inflatable structure being oriented such that the longitudinal edge 30 is adjacent to the machine 10.

The inflation nozzle 22 is positioned to direct fluid 46 into the openings 34 of the inflatable chambers 32 as the inflatable structure 26 is advanced in the machine direction 40, substantially parallel to the longitudinal edge 30, thereby inflating the inflatable chambers. By engaging the first sheet 36*a* and the second sheet 36*b* of the inflatable structure 26 together, the inflation of the inflatable chambers 32 may be facilitated as compared to an open edge. For instance, with an open edge, fluid which is directed toward openings in the inflatable structure may partially escape out through the open edge. Further, as the fluid is discharged from the nozzle 22, and also as the escaping fluid passes out through the open edge, the fluid may cause the sheets forming the edge to vibrate as a result of the "reed effect," which may result in undesirable noise production. Also, due to the vibrations, the openings to the inflatable chambers may not remain fully open during inflation. Thus, as a result of both the openings not being fully open and the ability of some of the fluid to escape out of the inflatable structure, a higher fluid pressure may be required to inflate the inflatable chambers. However, the use of a higher fluid pressure is also undesirable in that it may require more complex or expensive components to create the fluid pressure, and further, the increased fluid pressure may exacerbate the noise problem by increasing the vibrations.

Accordingly, the machine 10 herein described can facilitate more efficient inflation and/or reduce noise production by engaging the first sheet 36*a* and the second sheet 36*b* together along the longitudinal edge 30. This reduces the ability of the fluid 46 to escape through the longitudinal edge 30 and may further reduce any vibrations of the sheets 36*a*, 36*b* along the longitudinal edge. Thereby the openings 34 of the inflatable chambers 32 may remain more fully open, more fluid 46 may be directed toward the openings, and less noise may be produced. Further, as more fluid 46 travels through the openings 34 into the inflatable chambers 32 more easily, it may be possible to use a lower fluid pressure to inflate the inflatable chambers as compared to prior art.

Various embodiments of a sheet engagement device 18 may be used, such as embodiments using toothed or untoothed belts, as described above. When toothed belts are used, such as the first belt 52 and opposing second belt 62 shown in FIGS. 1 and 2, the intermeshing of the pluralities of teeth 54, 64 may reduce a dimension of the longitudinal edge 30 of the inflatable structure 26 in the machine direction 40. The sheet engagement device 18 may also emboss the inflatable structure 26 along the longitudinal edge 30 with a plurality of protrusions 94 and indentions 96 corresponding to the intermeshing pluralities of teeth 54, 64. The contracting of the length of the longitudinal edge 30 in the machine direction 40 provides additional benefits because the rest of the inflatable structure 26 may also tend to shrink in length in the machine direction when the inflatable chambers 32 are filled, which can otherwise distort the openings 34 of the inflatable chambers such that they do not remain fully open. Thus, by contracting the length of the longitudinal edge 30, the openings 34 may remain more fully open, which further facilitates inflation of the inflatable chambers 32, as described above. In particular, by contracting the length of the longitudinal edge 30 by an amount roughly equivalent to the amount of shortening of length of the inflatable portion of the inflatable structure 26 in the machine direction 40, distortion of the openings 34 may be avoided. Additionally, embossing the longitudinal edge 30 further resists noise produced by the "reed effect" by eliminating the planar nature of the longitudinal edge as the longitudinal edge contracts in the machine direction 40.

In alternate embodiments, two belts with untoothed respective first and second external surfaces may be used. In such embodiments, the length of the longitudinal edge 30 of the inflatable structure 26 may not be affected. Additionally, such an embodiment may not emboss the inflatable structure 26, depending on the pressure applied by the belts to the inflatable structure. However, even when the inflatable structure 26 is not embossed, this embodiment may provide beneficial results. For example, the sheet engagement device 18 may extend in the machine direction 40 in such a manner that the untoothed first external surface of the first belt 52 and the untoothed second external surface of the opposing second belt 62 engage the inflatable structure 26 therebetween from a location prior to the point at which the inflatable chambers 32 pass the nozzle 22 until a point at which the inflatable chambers are sealed by the sealing device 16, as will be described below. In such an embodiment, the first sheet 36*a* and the second sheet 36*b* may remain separated at the longitudinal edge 30 when they exit the machine 10 and may not have embossing thereon.

As also shown in FIG. 2, the sealing device 16 may be positioned just after the inflation nozzle 22 in the machine direction 40 so that it substantially contemporaneously seals closed the openings 34 of the inflatable chambers 32 as they are being inflated. Thus, when heated, the rotational contact between the sealing element 84 and the inflatable structure 26 as the drive roller 80 and the backing roller 82 counter-rotate against the inflatable structure 26 forms a longitudinal seal 48 as the inflatable structure is advanced in the machine direction 40. Thereby the sealing device 16 may seal closed the openings 34 by producing a longitudinal seal 48 between the first sheet 36*a* and the second sheet 36*b* (see FIG. 1), which also intersects the transverse seals 38 near the ends 42 thereof to enclose the fluid 46 within the inflatable chambers 32. In this manner, the inflatable chambers 32 of the inflatable structure 26 are converted into inflated inflatable chambers 50. The longitudinal seal 48 may be a continuous seal, i.e., a substantially linear, unbroken seal, which is interrupted only when the sealing device 16 is caused to stop making the seal, or it may form a discontinuous seal. The shape and pattern of the longitudinal seal 48 will depend on the shape and pattern of the sealing element 84, and thus various different seals may be produced as will be apparent to one of ordinary skill in the art.

Figure 3:
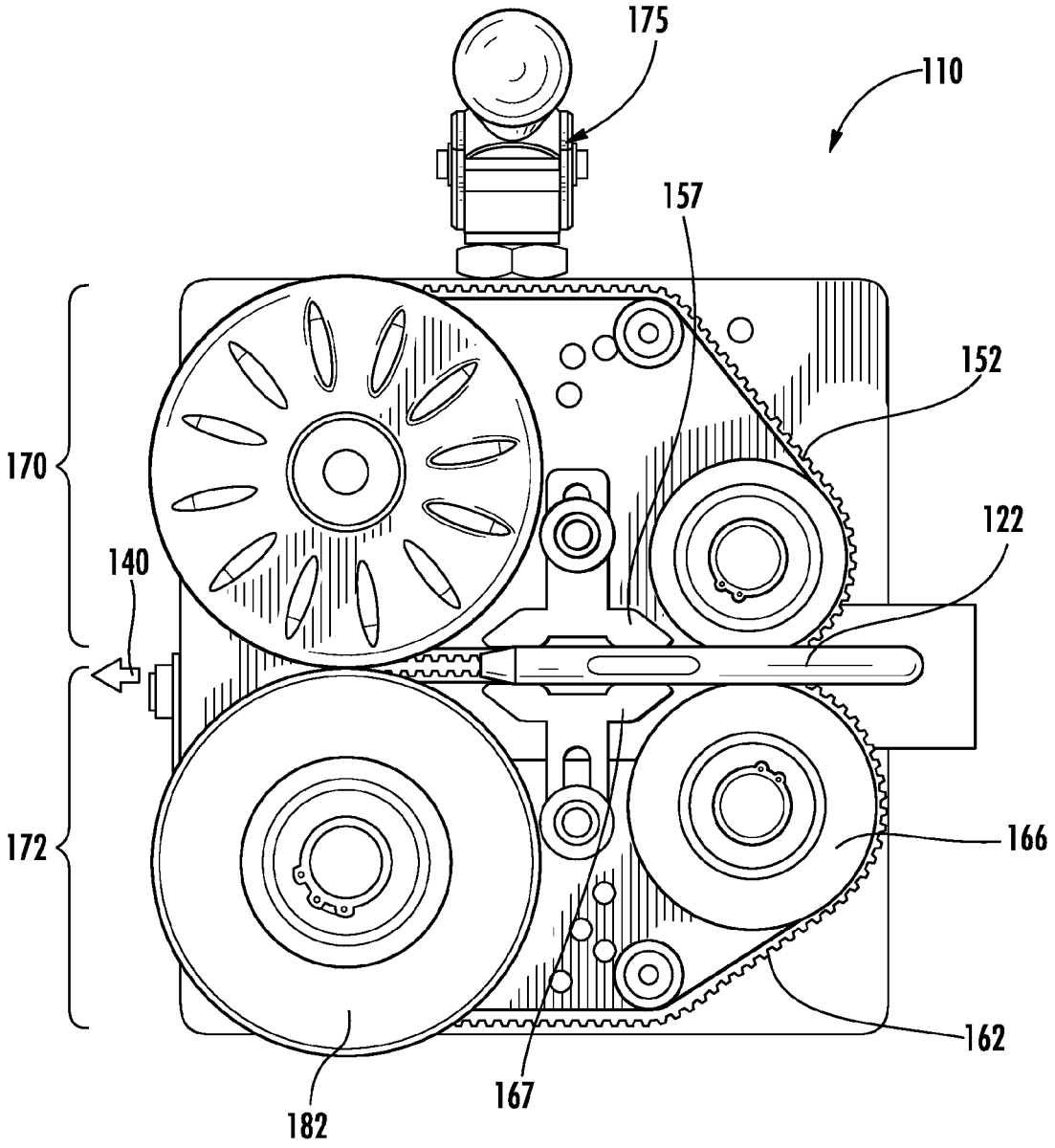
FIG. 3 is a frontal view of an embodiment of a machine for inflating and sealing an inflatable structure comprising an engaging assembly and an opposing assembly with a single release mechanism and a first belt and an opposing second belt having pluralities of teeth, wherein the engaging assembly and the opposing assembly are in an operational position.
Figure 4:
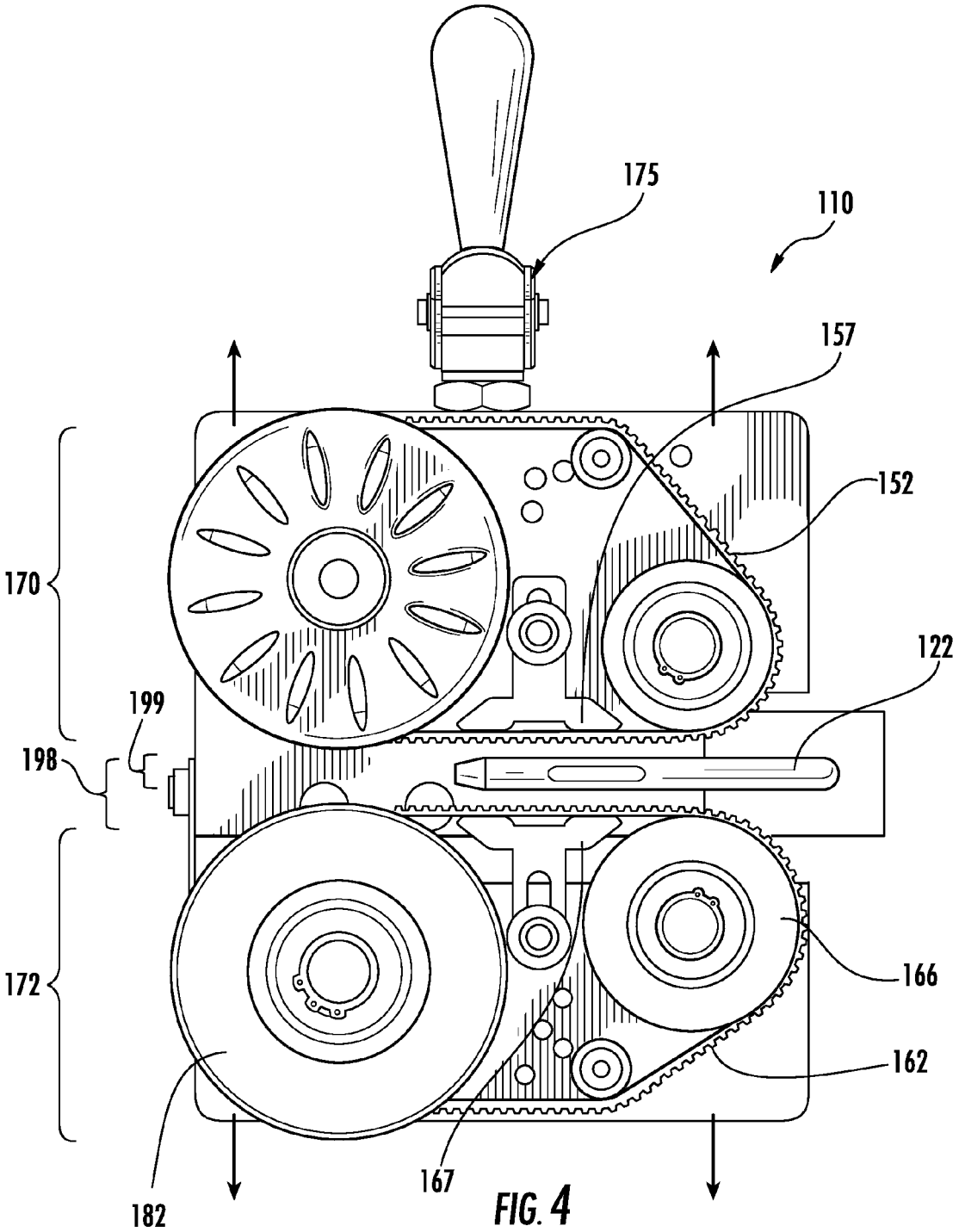
FIG. 4 is the embodiment of a machine of FIG. 3 wherein the engaging assembly and the opposing assembly are in a position facilitating insertion of an inflatable structure therebetween.

FIGS. 3 and 4 illustrate another embodiment of a machine 110 for inflating and sealing an inflatable structure. The machine 110 of FIGS. 3 and 4 is similar to the machine 10 of FIGS. 1 and 2. However, there are three main differences. The first such difference is that the machine 110 of FIGS. 3 and 4 additionally comprises an engaging body 157 and an opposing body 167. The engaging body 157 and the opposing body 167 may be part of the engaging assembly 170 and the opposing assembly 172, respectively. Further, the engaging body 157 and the opposing body 167 may be configured to engage the first belt 152 and the opposing second belt 162 therebetween. Additionally, the engaging body 157 and the opposing body 167 may engage the first belt 152 and the opposing second belt 162 at a position such that the engaging body, the opposing body, and the inflation nozzle 122 overlap in the machine direction 140. Such positioning assists in the engagement of a first sheet together with a second sheet along the longitudinal edge of an inflatable structure, which can further facilitate the inflation of inflatable chambers by further resisting fluid flow out the longitudinal edge. While the engaging body and the opposing body are illustrated in FIGS. 3 and 4 as fixed structures that do not rotate, in other embodiments either or both of the engaging body and the opposing body may comprise a roller or other rotary structure. Additionally, either or both of the engaging body and the opposing body may be spring loaded such that the opposing body and the engaging body compress the belts and sheets therebetween under the resulting spring force during operation.

The second main difference from the embodiment of FIGS. 1 and 2 is that there is a single release mechanism 175 which relatively displaces the opposing assembly 172, including the backing roller 182, the opposing body 167, and the opposing roller 166 from the engaging assembly 170. A third main difference is that the single release mechanism 175 also displaces the inflation nozzle 122 from the engaging assembly 170. In particular, as seen in FIG. 4, the opposing assembly 172 may be displaced from the engaging assembly 170 by a displacement distance 198, and the inflation nozzle 122 may be displaced from the engaging assembly by an intermediate displacement distance 199 which is less than the displacement distance. In such an embodiment, feeding of a first sheet and a second sheet of an inflatable structure on opposing sides of the nozzle 122 may be facilitated. For instance, when the intermediate displacement distance 199 is set to be half of the displacement distance 198, the inflation nozzle 122 may be positioned half way between the engaging assembly 170 and the opposing assembly 172. Thus, the first sheet and the second sheet of an inflatable structure may be more easily fed over the inflation nozzle 122 and between the engaging assembly 170 and the opposing assembly 172. At this point the single release mechanism 175 may then be used to move the inflation nozzle 122 and opposing assembly 172 to the normal operating position, as shown in FIG. 3.

Figure 5:
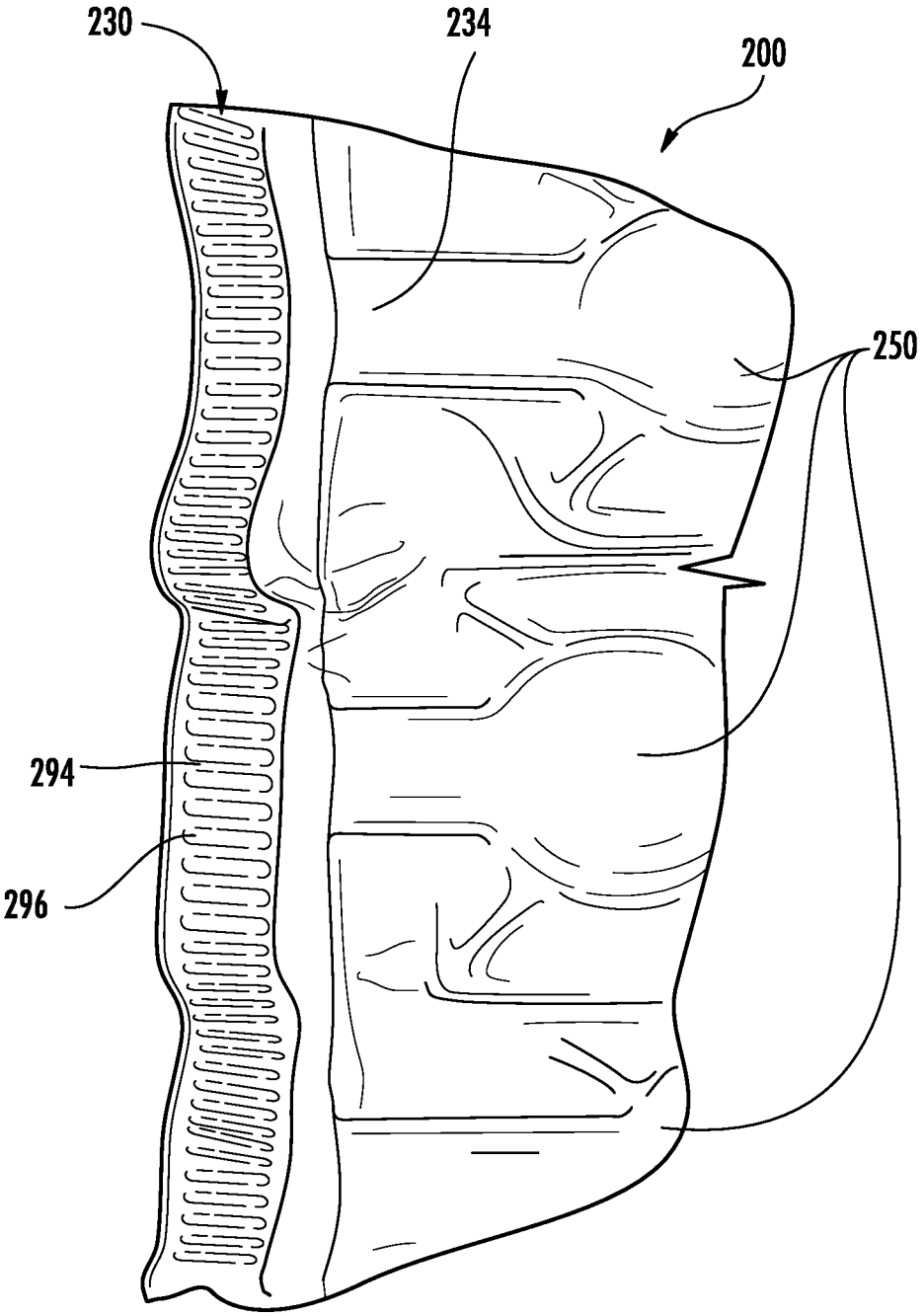
FIG. 5 is a top view of an embodiment of an inflated structure having an embossed longitudinal edge, such as may be produced by the embodiments of machines for inflating and sealing an inflatable structure of FIGS. 1-4.

As the result of passing through a machine for inflating an inflatable structure, such as the machine 10 illustrated in FIGS. 1 and 2 and the machine 110 shown in FIGS. 3 and 4, an inflated structure may be produced. As may be seen in FIG. 5 the inflated structure 200 may comprise a first sheet and a second sheet (see, e.g. FIG. 1), an embossed longitudinal edge 230, and a series of inflated chambers 250 formed between the sheets, each of the inflated chambers holding therein a quantity of a fluid and having a sealed opening 234 proximate the embossed longitudinal edge. As may be apparent to one having ordinary skill in the art, the inflatable structure 200 may comprise more than two sheets in other embodiments, and the sheets may also comprise separate layers of a single piece of flexible material. Further, although the embossed longitudinal edge 230 is shown 5 as comprising protrusions 294 and indentations 296 which are perpendicular to the longitudinal edge 230, the protrusions and/or indentations may be oriented in any other direction, as previously described.

Figure 6:
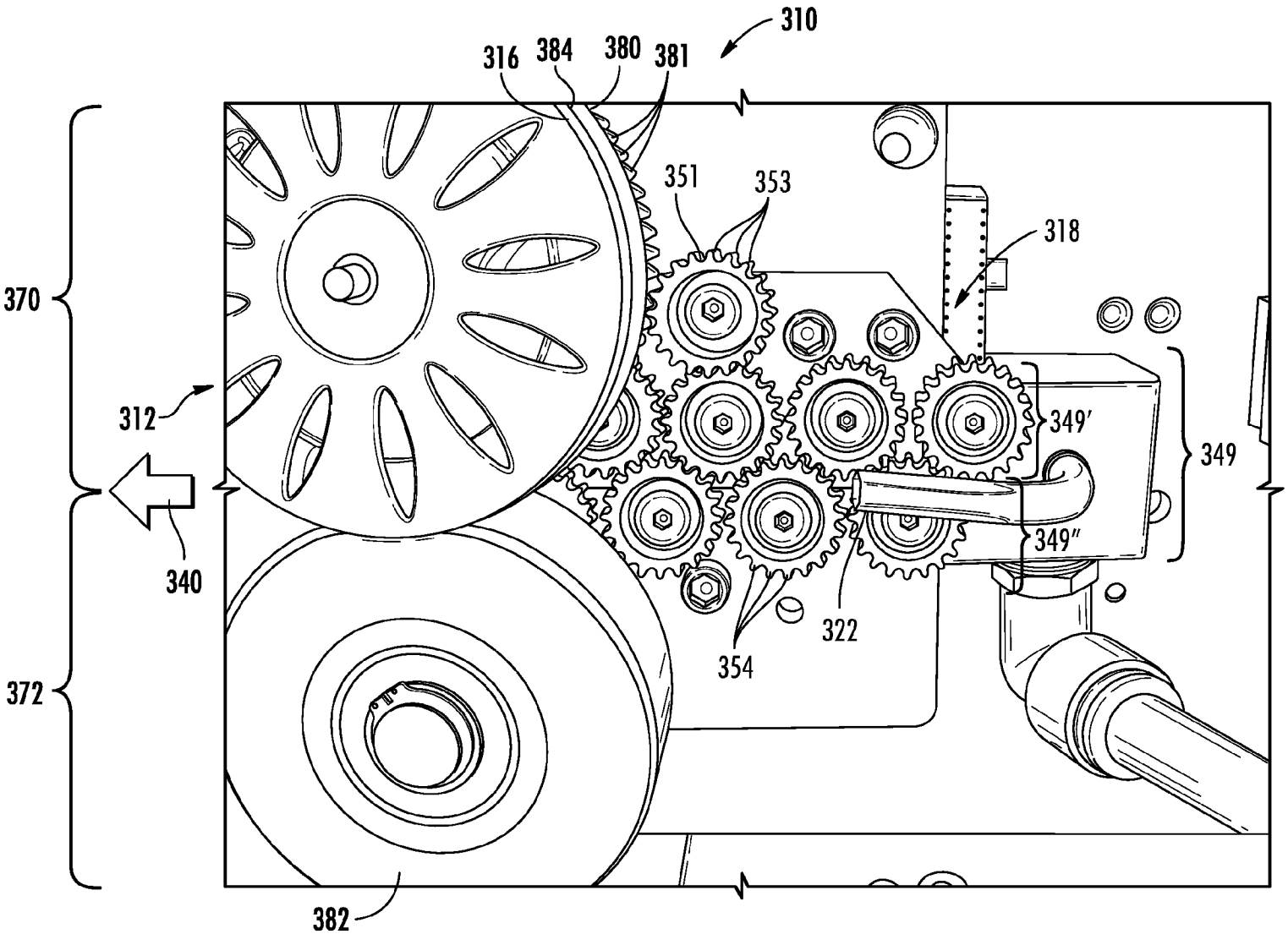
FIG. 6 is a perspective view of another embodiment of a machine for inflating and sealing an inflatable structure wherein the sheet engagement device comprises engagement rollers.

FIG. 6 illustrates an alternate embodiment of a machine 310 for inflating and sealing an inflatable structure wherein the sheet engagement device 318 comprises one or more engagement rollers 349 which may be used to engage the sheets of the inflatable structure. The engagement rollers 349 may comprise a first plurality of rollers 349' positioned on one side of the sheets and a second plurality of rollers 349" positioned on an opposite side of the sheets when the inflatable structure is passed through the machine 310. Thus, the first plurality of rollers 349' may intermesh with the second plurality of rollers 349" and thereby reduce a dimension of the longitudinal edge in the machine direction 340 as the inflatable structure moves along a tortuous path between the first plurality of rollers and the second plurality of rollers. In some embodiments, the intermeshing and/or contracting of the length of the longitudinal edge may be facilitated by one or more of the engagement rollers 349 having teeth 354. As with previous embodiments, contracting the length may further comprise embossing the longitudinal edge of the inflatable structure.

Additionally, the drive 312 in this embodiment may be rotationally coupled to one or more of the engagement rollers 349, such as through use of a transmission roller 351 which rotationally connects the drive 312 to one or more of the engagement rollers 349. The movement of the inflatable structure may act to rotationally connect all of the engagement rollers 349 when one of the engagement rollers is driven. Rotationally connecting the drive 312 to the engagement rollers 349 may be useful to prevent unintended tearing of the inflatable structure at perforations in the inflatable structure during inflation, whereas rotationally connecting the drive to the engagement rollers may not be needed when the inflatable structure does not have perforations or other separation facilitating structures. In the embodiment illustrated in FIG. 6, the drive roller 380 of the drive 312 may be provided with teeth 381 which mesh with teeth 353 on the transmission roller 351 when the engagement rollers 349 also have teeth 354.

The speed at which the engagement rollers 349 advance the inflatable structure may be different from the speed at which the drive 312 attempts to advance the inflatable structure. In particular, the engagement rollers 349 may advance the inflatable structure at a slower speed than the drive 312 attempts to advance the inflatable structure, such that the drive slips slightly with respect to the inflatable structure. This creates tension in the inflatable structure between the drive 312 and the engagement rollers 349, which may further assist in inflating the inflatable structure as described above. The speed at which the engagement rollers 349 advance the inflatable structure may be adjusted relative to the speed at which the drive 312 attempts to advance the inflatable structure by changing the radius to which the teeth 381 extend relative to the radius of the portion of the drive roller 380 which contacts the inflatable structure. For example, when the teeth 381 extend to a smaller radius than the radius of the portion of the drive roller 380 which contacts the inflatable structure, the engagement rollers 349 will advance the inflatable structure at a rate which is slower than the rate at which the drive 312 attempts to advance the inflatable structure. Regardless of the configuration of the drive 312, the first sheet of the inflatable structure may be separated from the second sheet of the inflatable structure such that the first sheet and the second sheet advance on opposite sides of the inflation nozzle 322.

As in the previously described embodiments, the machine 310 may define an engaging assembly 370 and an opposing assembly 372 with the drive 312 advancing the inflatable structure therebetween. A release mechanism such as those described above may be configured to displace at least a portion of the opposing assembly 372 from the engaging assembly 370 by a displacement distance. Similarly to above, the release mechanism may also be configured to displace the inflation nozzle 322 from the engaging assembly 370 by an intermediate displacement distance which is less than the displacement distance. In some embodiments, all or a portion of the opposing assembly 372 may be hingedly displaced relative to the engaging assembly 370 by the release mechanism. For example, a hinge may connect the opposing assembly 372 and the engaging assembly 370 at a first point, such as a front or back portion, with the release mechanism allowing the opposing assembly to rotate with respect to the hinge and displace downwardly. Further, the sealing device 316 may comprise a sealing element 384 in the engaging assembly 370 and at least one backing roller 382 in the opposing assembly 372. Thereby, when the opposing assembly 372 and the engaging assembly 370 are displaced from one another, the backing roller 382 and the sealing element 384 may be separated, which further facilitates insertion of the inflatable structure in the machine 310.

Many modifications and other embodiments of the invention set forth herein will come to mind to one skilled in the art to which the invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A method of inflating an inflatable structure having a longitudinal edge, at least two sheets and a series of inflatable chambers formed between the sheets, each of the inflatable chambers being capable of holding therein a quantity of a fluid and having an opening proximate the longitudinal edge for receiving the fluid during inflation, the method comprising:

engaging the sheets together along the longitudinal edge prior to the inflatable chambers being sealed, wherein at least one fluid outlet defined on an inflation nozzle is positioned between at least one of the inflatable chambers and the engaged portion of the longitudinal edge of the sheets;

directing a flow of fluid from the at least one fluid outlet of the inflation nozzle into the openings in the inflatable structure; and sealing the openings, wherein the step of directing the flow occurs during the step of engaging the sheets and wherein the step of engaging the sheets together restricts the ability of fluid exiting the inflation nozzle to escape through the longitudinal edge of the inflatable structure.

2. The method of claim 1, wherein the step of engaging the sheets comprises contracting the length of the longitudinal edge of the inflatable structure.

3. The method of claim 2, wherein the step of contracting the length comprises engaging the longitudinal edge of the inflatable structure between a first belt defining a plurality of teeth and an opposing second belt defining a plurality teeth.

4. The method of claim 2, wherein the step of contracting the length comprises embossing the longitudinal edge.

5. The method of claim 1, further comprising the step of advancing the inflatable structure in a machine direction substantially parallel to the longitudinal edge.

6. The method of claim 5, further comprising the step of separating a first sheet of the inflatable structure from a second sheet of the inflatable structure such that the step of advancing the inflatable structure comprises advancing the first sheet and the second sheet on opposite sides of the inflation nozzle.

* * * * *